US008471876B2

(12) United States Patent
Byun et al.

(10) Patent No.: US 8,471,876 B2
(45) Date of Patent: Jun. 25, 2013

(54) ORGANIC ELECTROLUMINESCENT DISPLAY DEVICE

(75) Inventors: Seung-Chan Byun, Incheon (KR); Jong-Moo Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 521 days.

(21) Appl. No.: 12/625,527

(22) Filed: Nov. 24, 2009

(65) Prior Publication Data

US 2010/0149226 A1 Jun. 17, 2010

(30) Foreign Application Priority Data

Dec. 16, 2008 (KR) ..... 10-2008-0127704

(51) Int. Cl.
*G09G 5/10* (2006.01)

(52) U.S. Cl.
USPC ..... 345/690; 345/77

(58) Field of Classification Search
None
See application file for complete search history.

(56) References Cited

U.S. PATENT DOCUMENTS

| | | | | |
|---|---|---|---|---|
| 6,906,725 | B2 * | 6/2005 | Turner | 345/589 |
| 7,164,400 | B2 * | 1/2007 | Mizukoshi et al. | 345/76 |
| 7,274,363 | B2 * | 9/2007 | Ishizuka et al. | 345/211 |
| 7,479,955 | B2 * | 1/2009 | Yoshida | 345/211 |
| 7,728,854 | B2 * | 6/2010 | Kim et al. | 345/690 |
| 7,808,458 | B2 * | 10/2010 | Choi et al. | 345/77 |
| 2005/0062696 | A1 * | 3/2005 | Lo | 345/82 |
| 2007/0085792 | A1 * | 4/2007 | Tseng | 345/89 |
| 2010/0103083 | A1 * | 4/2010 | Shin et al. | 345/76 |

* cited by examiner

*Primary Examiner* — Jason Olson
(74) *Attorney, Agent, or Firm* — Birch, Stewart, Kolasch & Birch, LLP

(57) ABSTRACT

An organic electroluminescent display device includes a display panel that includes sub-pixels which include organic light emitting diodes, respectively, to display a frame image made by image data by every frame; a data drive IC that outputs data voltages to the sub-pixels, respectively, by every frame, wherein the data voltages correspond to the image data, respectively; a current detecting portion that detects a first panel current, and generates a first comparison value corresponding to the first panel current; a current estimating portion that estimates a second panel current from the image data of the frame and generates a second comparison value corresponding to the second panel current; and a brightness control portion that compares the first and second comparison values and adjusts a brightness of a frame image after the frame according to the comparison result.

9 Claims, 8 Drawing Sheets

ORGANIC ELECTROLUMINESCENT DISPLAY DEVICE

The present invention claims the benefit of Korean Patent Application No. 10-2008-0127704, filed in Korea on Dec. 16, 2008, which is hereby incorporated by reference for all purposes as if fully set forth herein.

BACKGROUND OF THE INVENTION

1. Field of the Invention

The present invention relates to an organic electroluminescent display device, and more particularly, to an organic electroluminescent display (OELD) device and a method of driving the same.

2. Discussion of the Related Art

Until recently, display devices have typically used cathode-ray tubes (CRTs). Presently, many efforts and studies are being made to develop various types of flat panel displays, such as liquid crystal display (LCD) devices, plasma display panels (PDPs), field emission displays, and electro-luminescence displays (ELDs), as a substitute for CRTs. Of these flat panel displays, organic electroluminescent display (OELD) devices are self-luminescent display devices. The OELD devices operate at low voltages and have a thin profile. Further, the OELD devices have fast response time, high brightness, and wide viewing angles.

FIG. 1 is a circuit diagram illustrating a sub-pixel of an OELD panel according to the related art, and FIG. 2 is a wave form of voltages driving the sub-pixel of FIG. 1.

Referring to FIG. 1, the OELD device includes a gate line S and a data line D to define a sub-pixel. The sub-pixel includes a switching transistor SW, a driving transistor DR, a storage capacitor C, and an organic light emitting diode OLED. Gate and source of the switching transistor SW are connected to the gate and data lines S and D, respectively. A gate of the driving transistor DR is connected to a drain of the switching transistor SW, a drain of the driving transistor DR is connected to a cathode of the organic light emitting diode OLED. An anode of the organic light emitting diode OLED is applied with a first driving voltage VDD. A source of the driving transistor DR is connected to a second driving voltage VSS. The second driving voltage VSS may be lower than the first driving voltage VDD and be a ground voltage. A storage capacitor C is connected to both of the gate and source of the driving transistor DR. Each of the switching and driving transistors SW and DR may be a negative type and include an amorphous silicon layer.

Referring to FIGS. 1 and 2, when the gate voltage has an on level, for example, a high level VGH, the switching transistor SW is turned on. When the switching transistor SW is turned on, a data voltage Vdata is applied to the gate of the driving transistor DR and stored in the capacitor C. An amount of the data voltage Vdata determines an amount of a current applied to the organic light emitting diode OLED, and the amount of the current determines an amount of a light emitted from the organic light emitting diode OLED. In other words, the data voltage Vdata determines brightness of the emitted light.

However, since the driving thin film transistor DR uses the amorphous silicon, an electrical property, for example, a mobility of the thin film transistor Dr may be varied due to surroundings such as a temperature and an ambient light.

FIG. 3A is a graph illustrating variation of a panel current of the related art OELD panel according to variation of a temperature, and FIG. 3B is a graph illustrating variation of a panel current of the related art OELD panel according to exposure of an ambient light. In FIGS. 3A and 3B, the panel current is a total of currents applied to all organic light emitting diodes (OLED of FIG. 1) in the OELD panel.

Referring to FIG. 3A, during periods B and D, a cooling fan is operated to cool the driving transistors (DR of FIG. 1) in the OELD panel. Accordingly, the panel current during the periods B and D is thus lowered compared to the panel current during periods A, C and F when the cooling fan is not operated. In other words, according to variation of a temperature, the panel current of the OELD panel is greatly varied.

Referring to FIG. 3B, during a period B, an ambient light is incident on the driving transistors in the OELD panel and this causes a photo-leakage in the driving transistors. Accordingly, the panel current during the period B increases compared to the panel current during periods A and C when the ambient light is not incident on the OELD panel and the photo-leakage does not occur. In other words, according to exposure of an ambient light, the panel current of the OELD panel is greatly varied.

Such the variation of the panel current of the OELD panel due to the surroundings causes variation of brightness in displaying images. Accordingly, display quality and reliability is degraded.

SUMMARY OF THE INVENTION

Accordingly, the present invention is directed to an organic electroluminescent display device that substantially obviates one or more of the problems due to limitations and disadvantages of the related art.

An advantage of the present invention is to provide an organic electroluminescent display device that can improve display quality and reliability.

Additional features and advantages of the present invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, an organic electroluminescent display device includes a display panel that includes a plurality of sub-pixels which include a plurality of organic light emitting diodes, respectively, to display a frame image made by a plurality of image data by every frame; a data drive IC that outputs a plurality of data voltages to the plurality of sub-pixels, respectively, by every frame, wherein the plurality of data voltages correspond to the plurality of image data, respectively; a current detecting portion that detects a first panel current, which is a total of currents applied to the plurality of organic light emitting diodes during a frame, and generates a first comparison value corresponding to the first panel current; a current estimating portion that estimates a second panel current from the plurality of image data of the frame and generates a second comparison value corresponding to the second panel current, wherein the second panel current is a total of currents expected to be applied to the plurality of organic light emitting diodes during the frame; and a brightness control portion that compares the first and second comparison values and adjusts a brightness of a frame image after the frame according to the comparison result obtained by the brightness control portion.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to illustrated embodiments of the present invention, which are illustrated in the accompanying drawings.

Figure 4:
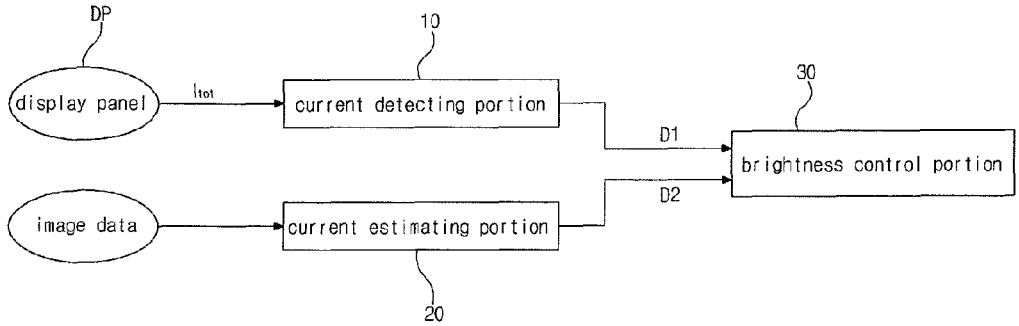
FIG. 4 is a block diagram illustrating an OELD device according to an embodiment of the present invention.
Figure 5:
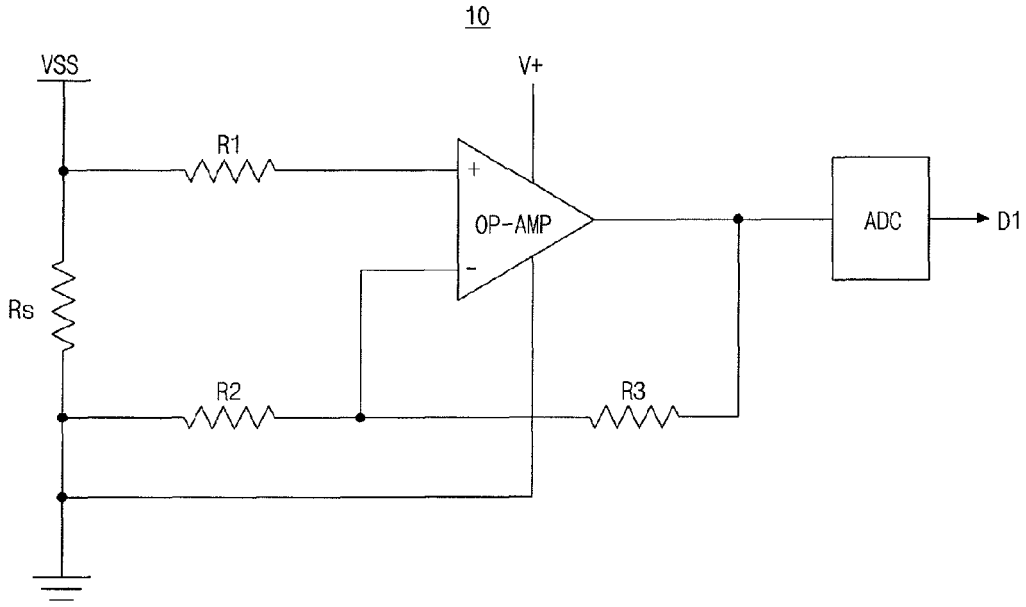
FIG. 5 is a circuit diagram illustrating a current detecting portion of FIG. 4.
Figure 6:
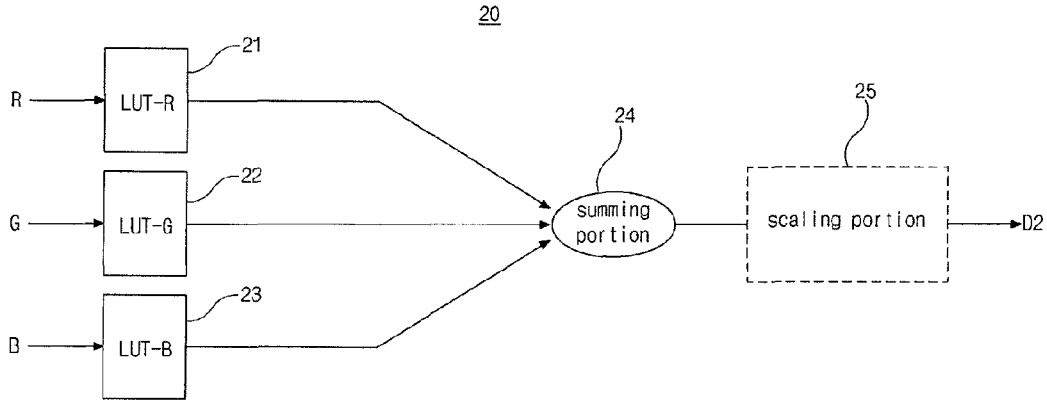
FIG. 6 is a block diagram illustrating a current estimating portion of FIG. 4.
Figure 7:
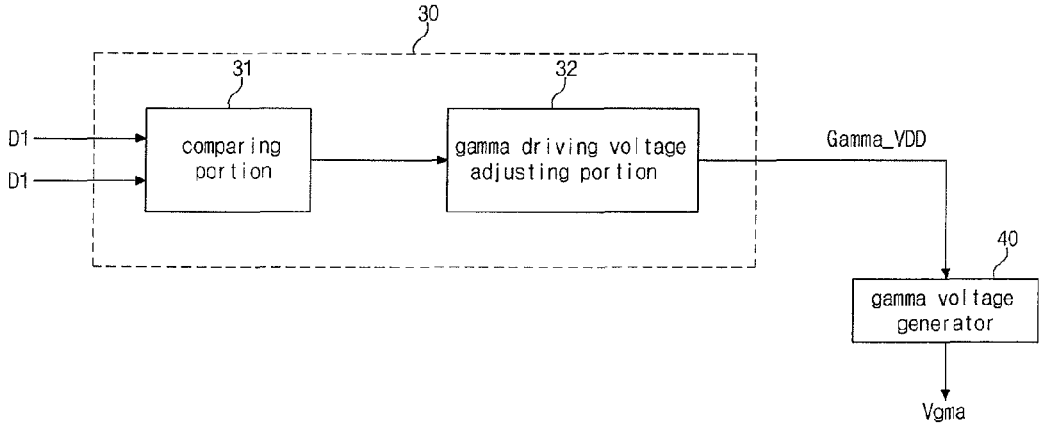
FIG. 7 is a block diagram illustrating a brightness control portion of FIG. 4.
Figure 8:
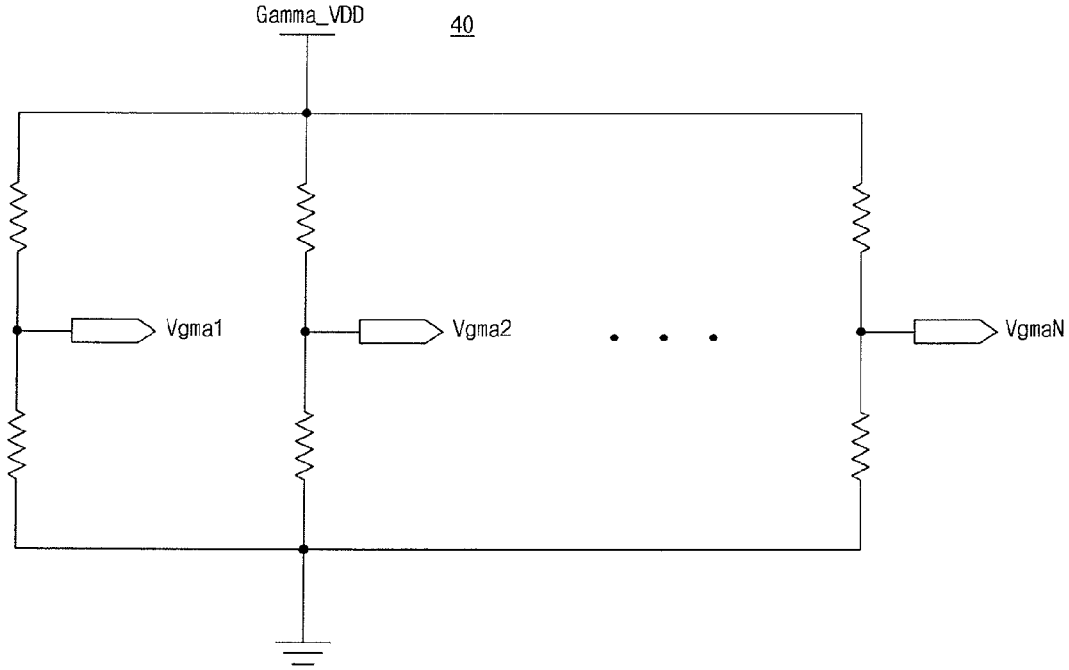
FIG. 8 is a circuit diagram illustrating a gamma voltage generator of FIG. 7.

FIG. 4 is a block diagram illustrating an OELD device according to an embodiment of the present invention, FIG. 5 is a circuit diagram illustrating a current detecting portion of FIG. 4, FIG. 6 is a block diagram illustrating a current estimating portion of FIG. 4, FIG. 7 is a block diagram illustrating a brightness control portion of FIG. 4, and FIG. 8 is a circuit diagram illustrating a gamma voltage generator.

Referring to FIGS. 4 to 8, the OELD device according to the embodiment includes a display panel DP, a current detecting portion 10, a current estimation portion 20 and a brightness control portion 30. The display panel DP is an OELD panel.

Figure 1:
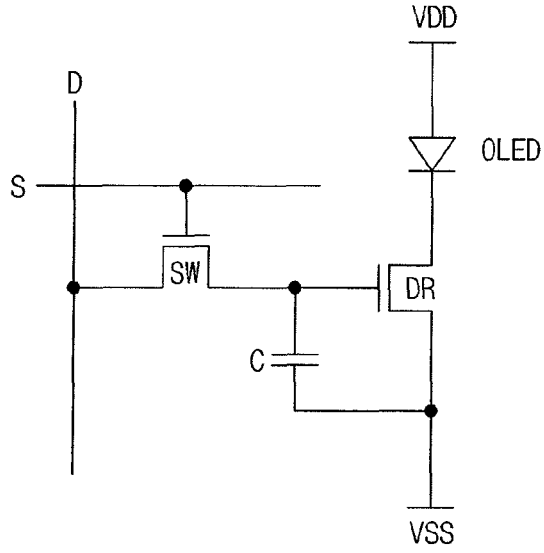
FIG. 1 RELATED ART
FIG. 1 is a circuit diagram illustrating a sub-pixel of an OELD panel according to the related art.
Figure 2:
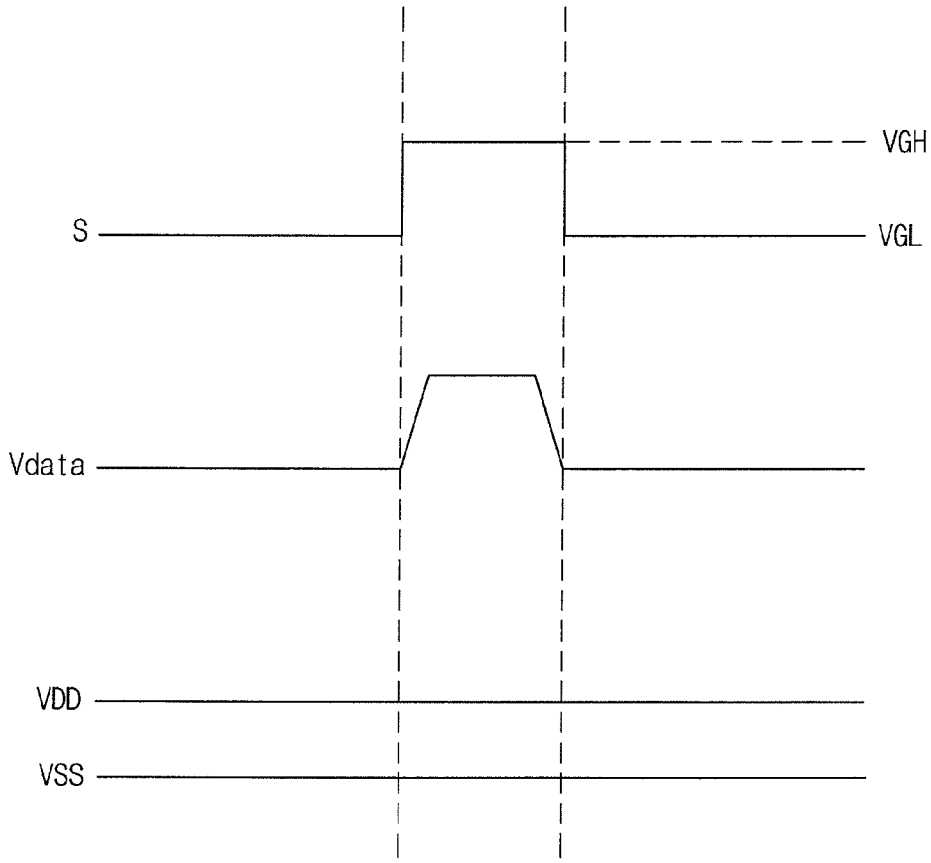
FIG. 2 RELATED ART
FIG. 2 is a wave form of voltages driving the sub-pixel of FIG. 1.
Figure 3A:
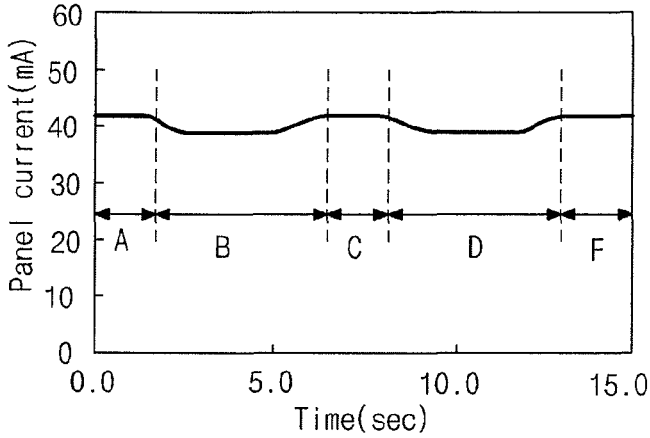
FIG. 3A RELATED ART
FIG. 3A is a graph illustrating variation of a panel current of the related art OELD panel according to variation of a temperature.
Figure 3B:
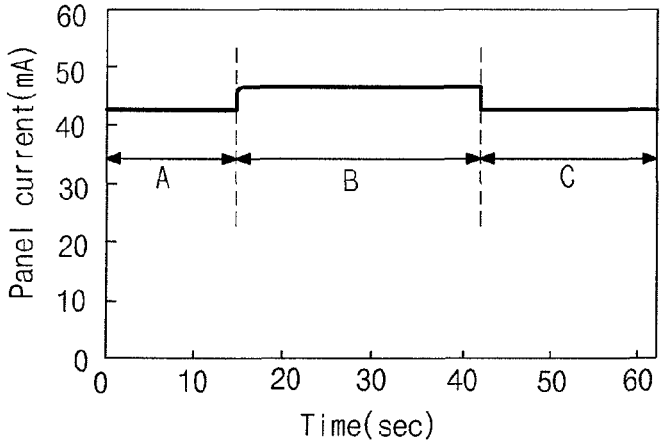
FIG. 3B RELATED ART
FIG. 3B is a graph illustrating variation of a panel current of the related art OELD panel according to exposure of an ambient light.

The display panel DP may have a structure similar to the OELD panel of FIG. 1. Explanations of parts similar to parts of FIG. 1 may be omitted. Hereinafter, reference characters of FIG. 1 may be used in the embodiment. The display panel DP includes a plurality of sub-pixels in a matrix form.

The current detecting portion 10 functions to detect a panel current i.e., a total current Itot of the display panel DP. In other words, the total current Itot is a total of currents applied to all sub-pixels of the display panel DP. To detect the total current Itot, the current detecting portion 10 may include a sensing resistor Rs connected to a second driving voltage (VSS) input terminal, an operational amplifier (OP-AMP) amplifying a voltage applied to the sensing resistor Rs, and an analog-to-digital converter (ADC) to convert an output from the OP-AMP into a first comparison value D1 in digital format.

The sensing resistors Rs may be connected to driving transistors DR of all sub-pixels in the display panel DP so that the sensing resistor Rs is supplied with the total current Itot applied to organic light emitting diodes OLED of all sub-pixels in the display panel DP. For example, the sensing resistor Rs may be connected to the second driving voltage (VSS) input terminal which is connected to the driving transistors DR of all sub-pixels in the display panel DP. Accordingly, the sensing resistor Rs can sense the total current Itot applied to all organic light emitting diodes OLED in the display panel DP. Alternatively, the sensing resistor Rs may be connected to the first driving voltage (VDD) input terminal instead of the second driving voltage (VSS) input terminal.

The OP-AMP amplifies a voltage sensed through the sensing resistor Rs by a predetermined gain. To do this, first to third resistors R1 to R3 may be configured. For example, the first resistor R1 is connected to one end of the sensing resistor Rs and an non-inverting terminal (+), the second resistor R2 is connected to the other end of the sensing resistor Rs and an inverting terminal (−), and the third resistor R3 is connected to the inverting terminal (−) and an output terminal of the OP-AMP. As such, the OP-AMP of the embodiment may be an inverting operational amplifier. Values of the first to third resistors R1 to R3 may be appropriately set by a manufacturer.

As described above, through the sensing resistor Rs and the OP-AMP, a voltage in proportional to the total current Itot and amplified by the predetermined gain is obtained.

The voltage outputted from the OP-AMP is inputted to the ADC. The ADC outputs the digital first comparison value D1. The first comparison value D1 may be expressed in n-bit digital format. For example, the n-bit is 8 or 10-bit but not limited.

As described above, through the sensing resistor Rs, the OP-AMP and the ADC, the first comparison value D1 corresponding to the total current Itot of the display panel DP is obtained.

The current estimating portion 20 produces a second comparison value D2 corresponding to a total current estimated according to frame image data inputted to the OELD device. In other words, the estimated total current is a total current which is expected to be applied to all organic light emitting diodes OLED in the display panel DP. To do this, the current estimating portion 20 includes a look-up table including a R (red) look-up table (LUT-R) 21, a G (green) look-up table (LUT-G) 22, and a B (blue) look-up table (LUT-R) 23, and a summing portion 24.

For example, RGB image data by the frame are inputted to the OELD device to display a frame image. Each RGB image data corresponds to a pixel and includes a R image data, a G image data and a B image data corresponding to a R sub-pixel, a G sub-pixel and a B sub-pixel, respectively, of the pixel.

For example, the LUT-R 21 stores a plurality of predetermined values, for example, a plurality of estimated current values corresponding to a plurality of levels, respectively, available to the inputted R image data, and each estimated current value indicates a current to desirably display the corresponding R image data with a suitable brightness through the organic light emitting diode of the corresponding R sub-pixel. Likewise, each of the LUT-G 22 and the LUT-B 23 stores a plurality of predetermined values, for example, a plurality of estimated current values corresponding to a plurality of levels, respectively, available to each of the inputted G and B image data, and each estimated current value indicates a current to desirably display each of the corresponding G and B image data with a suitable brightness through the organic light emitting diode of each of the corresponding G and B sub-pixels. Such the estimated current values for each of the LUT-R 21, LUT-G 22 and LUT-B 23 may be obtained under experiment or simulation by a manufacturer.

Accordingly, each of the LUT-R 21, LUT-G 22 and LUT-B 23 outputs the estimated current value corresponding to the image data inputted thereto. All estimated current values of the RGB frame image data are supplied to the summing portion 24. The summing portion 24 sums all estimated current values into the estimated total current. Accordingly, the summing portion 24 outputs a digital second comparison value D2 corresponding to the estimated total current.

The current estimating portion 20 may further includes a scaling portion 25. The scaling portion 25 scales a bit number of the second comparison value D2 when the second comparison value D2 is different in bit number from the first comparison value D1. For example, as the image data inputted to the OELD device varies in bit number, the second comparison value D2 also varies in bit number thus the bit number of the second comparison value D2 is different from that of the first comparison value D1. In this case, the scaling portion 25 scales the bit number of the second comparison value D2 such that the second comparison value D2 has the same bit number as the first comparison value D1. For example, scaling the bit number is performed by bit shifting operation.

The brightness control portion 30 includes a comparing portion 31 and a gamma driving voltage adjusting portion 32. The comparing portion 31 compares the first comparison value D1 and the second comparison value D2 and outputs a comparison result. The gamma driving voltage adjusting portion 32 adjusts a level of a gamma driving voltage Gamma_VDD according to the comparison result of the comparing portion 31. The gamma driving voltage Gamma_VDD is supplied to a gamma voltage generator 40 to generate a plurality of gamma voltages Vgma. The gamma voltages Vgma are used to convert the digital image data into an analog data voltage. The data voltage is supplied to the corresponding sub-pixel through the data line D.

In more detail, if the comparison result that the first comparison value D1 is more than the second comparison value D2 is obtained, this indicates that the brightness of the frame image displayed through display panel DP is higher than expected. Accordingly, when the comparison result that the first comparison value D1 is more than the second comparison value D2 is obtained, the gamma driving voltage adjusting portion 32 decreases the level of the gamma driving voltage 32 outputted therefrom. On the other hand, if the comparison result that the first comparison value D1 is less than the second comparison value D2 is obtained, this indicates that the brightness of the frame image displayed through the display panel DP is lower than expected. Accordingly, when the comparison result that the first comparison value D1 is less than the second comparison value D2 is obtained, the gamma driving voltage adjusting portion 32 increases the level of the gamma driving voltage 32 outputted therefrom.

The gamma voltage generator 40 may include a plurality of resistors to divide the gamma driving voltages Gamma_VDD into a plurality of voltage levels. For example, as shown in FIG. 8, a plurality of resistor strings are configured in parallel, and one end of each resistor string is supplied to the gamma driving voltage Gamma_VDD while the other end of each resistor string is connected to a ground terminal. However, configuration of the resistors is not limited. For example, one resistor string, where a plurality of resistors are arranged in series, may be used. As such, the gamma voltage generator 40 uses a voltage dividing circuit to generate a plurality of gamma voltages Vgma1 to VgmaN. The generated gamma voltages Vgma1 to VgmaN are supplied to a data drive IC, for example, a digital-to-analog converter (DAC) in the data drive IC. The DAC converts the digital image data into the analog data voltage. The data voltage is supplied to the corresponding sub-pixel through the corresponding data line.

Figure 9:
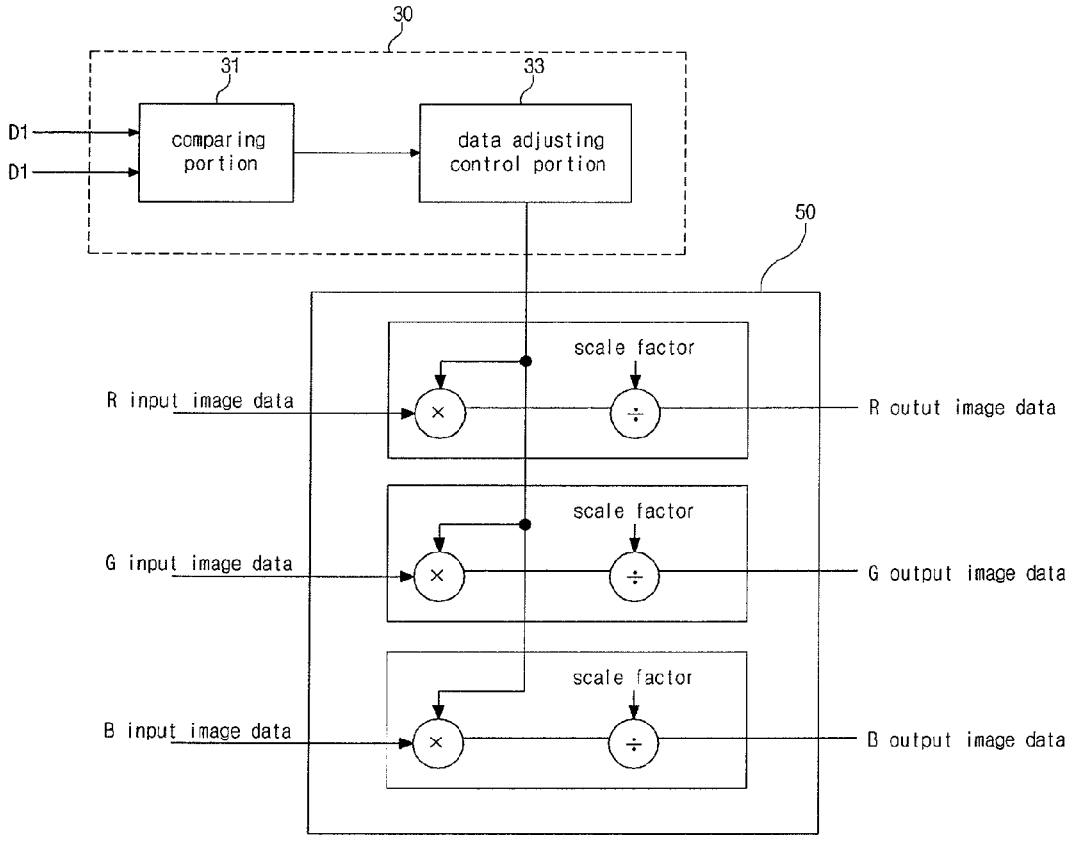
FIG. 9 is a block diagram illustrating a brightness control portion and a data adjusting portion in an OELD device according to another embodiment of the present invention.

Alternatively, image data may be adjusted according to the comparison result using a brightness control portion 30 and a data adjusting portion 50 of FIG. 9. FIG. 9 is a block diagram illustrating a brightness control portion and a data adjusting portion in an OELD device according to another embodiment of the present invention.

For example, to adjust image data, the brightness control portion 30 may include a comparing portion 31 and a data adjusting control portion 33. The comparing portion 31 of FIG. 9 compares the first and second comparison values D1 and D2 and outputs a comparison result, in similar to the comparing portion 31 of FIG. 7. The data adjusting control portion 33 controls a data adjusting portion 50. To do this, the data adjusting control portion 33 outputs a control signal, for example, an amplify ratio signal, and the image data is amplified by the amplify ratio. In more detail, if the comparison result that the first comparison value D1 is more than the second comparison value D2 is obtained, this indicates that the brightness of the frame image displayed through the display panel DP is higher than expected. Accordingly, when the comparison result that the first comparison value D1 is more than the second comparison value D2 is obtained, the data adjusting control portion 33 decreases the amplify ratio. On the other hand, if the comparison result that the first comparison value D1 is less than the second comparison value D2 is obtained, this indicates that the brightness of the frame image displayed through the display panel DP is lower than expected. Accordingly, when the comparison result that the first comparison value D1 is less than the second comparison value D2 is obtained, the data adjusting control portion 33 increases the amplify ratio.

The data adjusting portion 50 adjusts the image data using the amplify ratio. For example, the R, G and B input image data are amplified by the amplify ratio. This amplification operation is to amplify a gray level of the image data. Then, the amplified R, G and B input image data are divided by corresponding scale factors to output R, G and B output image data. The R, G and B output image data may be supplied to the data drive IC. The data drive IC converts the digital R, G and B output image data into analog R, G and B data voltages, respectively, through the DAC of the data drive IC. In this case, irrespective of the comparison result, the gamma voltage generator 40 outputs constant gamma voltages to the DAC of the data drive IC.

The embodiment of FIG. 9 can be effectively used in case of minutely adjusting voltage and maximize the effect of the minute adjusting.

As described above, when the estimated total current for a frame is different from the detected total current for the frame, gamma voltages or image data for a next frame are adjusted. According to this adjusting operation, the display panel DP displays frame images with desired brightness even though the electrical properties of the driving TFTs are varied due to surroundings such as a temperature and an ambient light.

Figure 10A:
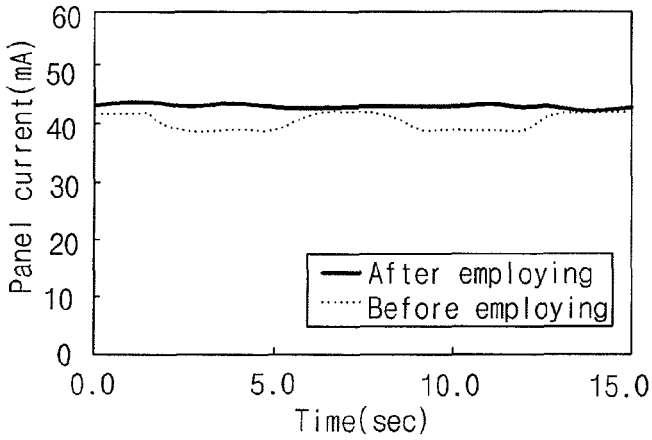
FIG. 10A is a graph illustrating panel currents before and after employing the driving method according to the embodiments of the present invention when a temperature is varied.
Figure 10B:
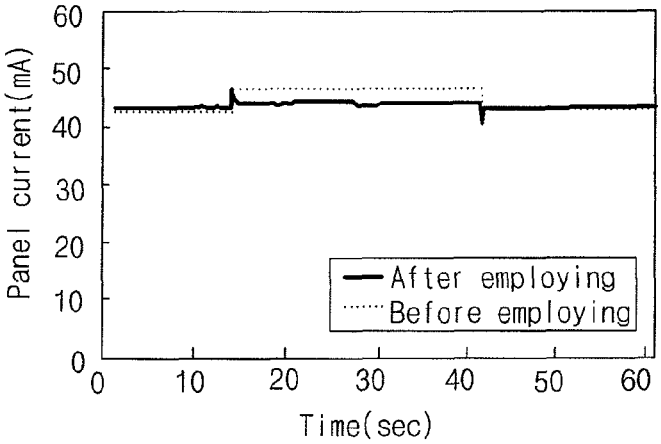
FIG. 10B is a graph illustrating panel currents before and after employing the driving method according to the embodiments of the present invention.

FIG. 10A is a graph illustrating panel currents before and after employing the driving method according to the embodiments of the present invention when a temperature is varied, and FIG. 10B is a graph illustrating panel currents before and after employing the driving method according to the embodiments of the present invention. It is assumed that the same frame image data continue to be supplied to the OELD device for some frames.

In the embodiments, when the gray levels of the image data or the gamma voltages are adjusted to increase, levels of the data voltages outputted from the data drive IC to the display panel DP also increase thus the panel current and brightness of the frame image increase. When the gray levels of the image data or the gamma voltages are adjusted to decrease, levels of the data voltages outputted from the data drive IC to the OELD panel also decrease thus the panel current and brightness of the frame image decrease. Accordingly, referring to FIGS. 10A and 10B, before employing the driving method according to the embodiments of the present invention, the panel current of the related art is varied due to a temperature and an ambient light. However, after employing the driving method according to the embodiments of the present invention, the panel current of the embodiments is substantially not varied but substantially uniform. Therefore, the OELD device can display frame images with desired brightness. As a result, display quality and reliability can be improved.

The embodiments as described above may be applied to other type display devices, for example, an LCD device, a PDP device and the like.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic electroluminescent display device, comprising:

a display panel that includes a plurality of sub-pixels which include a plurality of organic light emitting diodes, respectively, to display a frame image made by a plurality of image data by every frame;

a data drive IC that outputs a plurality of data voltages to the plurality of sub-pixels, respectively, by every frame, wherein the plurality of data voltages correspond to the plurality of image data, respectively;

a current detecting portion that detects a first panel current, which is a total of currents applied to the plurality of organic light emitting diodes during a frame, and generates a first comparison value corresponding to the first panel current;

a current estimating portion that estimates a second panel current from the plurality of image data of the frame and generates a second comparison value corresponding to the second panel current, wherein the second panel current is a total of currents expected to be applied to the plurality of organic light emitting diodes during the frame; and a brightness control portion that compares the first and second comparison values and adjusts a brightness of a frame image after the frame according to the comparison result obtained by the brightness control portion, wherein the brightness control portion includes a comparing portion that compares the first and second comparison values, and a gamma driving voltage adjusting portion that adjusts a gamma driving voltage supplied to one end of at least one resistor string of a gamma voltage generator according to the comparison result, and wherein when the first comparison value is more than the second comparison value, the gamma driving voltage adjusting portion decreases a level of the gamma driving voltage, and when the first comparison value is less than the second comparison value, the gamma driving voltage adjusting portion increases the level of the gamma driving voltage.

2. The device according to claim 1, wherein each sub-pixel further includes a switching transistor connected to a gate and a data line, and a driving transistor connected to the switching transistor, and wherein the data voltage is applied to the driving transistor through the data line and the switching transistor.

3. The device according to claim 2, wherein the current detecting portion includes:

a sensing resistor that is connected to the driving transistors of the plurality of sub-pixels;

an operational amplifier that amplifies a voltage sensed by the sensing resistor; and an analog-to-digital converter converting an output from the operational amplifier into the first comparison value in digital format.

4. The device according to claim 1, wherein the current estimating portion includes:

a look-up table that stores a plurality of estimated current values corresponding to a plurality of levels, respectively, available to an image data inputted thereto; and a summing portion that sums a plurality of estimated current values corresponding to the plurality of image data of the frame and outputted from the look-up table and generates the second comparison value corresponding to the summed plurality of estimated current values.

5. The device according to claim 4, wherein the second comparison value is in digital format.

6. The device according to claim 5, wherein the current estimating portion further includes a scaling portion that scales a bit number of the second comparison value such that the bit number of the second comparison value is the same as a bit number of the first comparison value.

7. The device according to claim 1, wherein the gamma voltage generator divides the gamma driving voltage into a plurality of gamma voltages, and wherein the data drive IC includes a digital-to-analog converter that converts a plurality of image data inputted thereto into the plurality of data voltages, respectively, using the plurality of gamma voltages.

8. The device according to claim 7, wherein the at least one resistor string includes a plurality of resistors to divide the gamma driving voltage into the plurality of gamma voltages.

9. The device according to claim 1, wherein the brightness of the frame image after the frame is adjusted to increase when the comparison result indicates that the first comparison value is less than the second comparison value, and is adjusted to decrease when the comparison result indicates that the first comparison value is more than the second comparison value.

* * * * *